United States Patent [19]

Franke et al.

[11] Patent Number: 4,909,122

[45] Date of Patent: Mar. 20, 1990

[54] PORTABLE DEVICE FOR PRESTRESSING AND HOLDING MUSICAL INSTRUMENT STRINGS

[76] Inventors: Michael Franke, Rheinstrasse 73, D-6200 Wiesbaden 1; Joachim Hutterer, Dotzheimer Strasse 28, D-6500 Wiesbaden, both of Fed. Rep. of Germany

[21] Appl. No.: 293,936

[22] Filed: Jan. 5, 1989

[30] Foreign Application Priority Data

Jan. 7, 1988 [DE] Fed. Rep. of Germany ..... 8800068

[51] Int. Cl.[4] ..... G10G 7/00

[52] U.S. Cl. ..... 84/329; 84/453

[58] Field of Search ..... 84/329, 453; 206/314

[56] References Cited

U.S. PATENT DOCUMENTS 450,808 4/1891 Faxon ..... 84/306

1,262,518 4/1918 Klein ..... 84/329

2,132,792 10/1938 Kluson ..... 84/306

4,121,494 10/1978 Reno et al. ..... 84/453

FOREIGN PATENT DOCUMENTS 83319 12/1919 Switzerland ..... 84/329

*Primary Examiner*—Lawrence R. Franklin

*Attorney, Agent, or Firm*—H. Gibner Lehmann; K. Gibner Lehmann

[57] ABSTRACT

Small portable device for pre-stressing and holding replacement strings for a musical instrument, comprises a beam part along which the strings extend and to one end of which they are fastened. The other end of the beam part has manually operable string attachment and draft keys, for tensioning the strings the desired amount. The beam part has frets spaced with relation to the diapason of the musical instrument, to aid in tuning the replacement strings to the necessary pitch.

8 Claims, 1 Drawing Sheet

PORTABLE DEVICE FOR PRESTRESSING AND HOLDING MUSICAL INSTRUMENT STRINGS

STATEMENT AS TO RIGHTS TO INVENTIONS MADE UNDER FEDERALLY-SPONSORED RESEARCH AND DEVELOPMENT

Research and development of the present invention and application have not been Federally-sponsored, and no rights are given under any Federal program.

BACKGROUND OF THE INVENTION

1. Field of the Invention

This invention relates to devices for keeping in readiness prestressed reserve strings for musical instruments, particularly violins and violas, should string changing become necessary.

2. Description of the Related Art including information Disclosed Under 37 CFR §§1.97-1.99

When playing stringed instruments, in particular violins and violas, one sometimes finds it necessary to change one or another string quickly during a concert or performance. This is especially important, for instance, if a string breaks during a concert at which time it is essential to make the instrument playable again as fast as possible.

Up until the present, so far as we are aware, reserve strings are kept in the unstretched state, such as being coiled up. If such a string is used as a replacement on the instrument directly from its unstretched state, a relatively long time is required until tone stabilization is reestablished after the restringing. Therefore, repeated re-tuning has thus far been required after a string was changed, and such is normally either not possible during a concert, or at least is most disturbing.

SUMMARY OF THE INVENTION

Accordingly, it is an object of the present invention to provide an improved device by means of which tone stabilization can be regained very quickly after it becomes necessary to change a string.

According to the invention, this problem is solved by the provision of a pre-stressed string supply in the form of a device which prestretches and holds reserve strings, said device comprising a string holder consisting of a head part and with a draft device for the strings and a beam along which the strings are disposed and to which corresponding ends of the strings can be fastened.

What the invention accomplishes in a simple manner is that reserve strings are not only immediately available for a string change to be performed quickly, but also that the reserve strings are always pre-stressed by a correct amount and thus kept in readiness with a tension which is right for the specific musical instrument. Although the reserve strings when needed on the musical instrument must first be momentarily removed from the prestretching and holding device whereby they might be considered to return somewhat to an unstretched state, we have found that, surprisingly, no significant and deleterious relaxation in the strings occurs when they are changed relatively quickly. After installation of a prestretched string in the instrument, therefore, tone stabilization is regained very quickly, which is not possible when installing unstretched strings to a musical instrument.

It has proved particularly advantageous within the scope of the invention to provide the beam of the prestretching device with a length that essentially corresponds to the required string length, and to provide on the beam one or more transverse seating elements or frets for the strings, which are arranged in a mutual spacing that corresponds to the diapason of the respective instrument type for which the reserve strings are intended. The length of the beam should be such that corresponding ends of the reserve strings can be fastened securely to the beam and their other corresponding ends introduced into the draft or stretching device. The frets, mutually spaced in accordance with the diapason of the respective instrument type, offer the possibility to the user of the device that the reserve strings can be given a tension by the prestretching device which essentially corresponds to the necessary string tension that the string should attain through tuning after having been replaced on the musical instrument. This requires no difficult or complicated measures on the part of the user. All the user has to do when adjusting the pretension of the reserve strings in the prestretching device is to determine the tone level by plucking. Due to the spacing of the string frets according to the diapason spacing of the respective musical instrument type, it is made certain that when the respective basic tone of the string is reached, it has essentially the same tensions as that which tuning should achieve in the instrument.

In a particularly simple embodiment of the invention, the head part has a plate which carries the tensioning devices and one end of which plate is connected to the beam. Advantageously, one end of the beam can, at least in part, extend under or on the back side of the plate. Joining the plate to the beam can then be accomplished very simply by gluing or else by means of fastening elements such as screws and the like.

Depending on the number of strings to be accommodated by the pretensioning device, the number of stretching or draft element to be provided should correspond to the said number. It has proved to be particularly purposeful in this respect to keep one reserve string in readiness in the pretensioned device for each string provided on the stringed musical instrument. A separate tensioning or draft element thus would then be provided for each individual reserve string. The tensioning or draft elements can each contain a shaft-mounted worm wheel which engages a worm, the shaft of the wheel forming a retaining or holding means for one end of a string. These shafts are preferably mounted in holes in the plate, and they protrude at the underside or backside of the plate. This arrangement makes it easy to operate the tensioning elements. For their operation, the front faces of the worms can be provided with square or hexagonal heads so that they can be turned or manually operated easily with a suitable wrench. This makes it possible for the tensioning elements to be of very small design; but if this is not important, the worms could also be provided with small knob-type handles so that they can be turned without the aid of a tool.

According to another advantageous embodiment of the invention, the tension element shafts are mounted in holes in the retention plate and protrude on the backside or underside of the retention plate. It is purposeful for the retention plate to project laterally beyond the beam that is joined to it, so that there remains enough room to accommodate the shafts. Expediently, the head part or retention plate has a rounded end as shown. This shaping, taken with the lateral projection of the retention plate beyond the beam, is of particular advantage in connection with a sheath that is preferably to be provided within the scope of the invention, enclosing the beam and including the strings carried thereby. The sheath can be of an essentially rigid, tubular configuration. Such a sheath can as well be of essentially circular cross-section. But it is also imaginable to provide a flexible sheath, which can be pulled over the beam with the strings it accommodates. In any case, the sheath should preferably consist of transparent plastic.

In order to form in a simple manner a retention for the strings, the beam can consist of a square section tube, along whose mutually opposite walls the strings extend. At the end opposite the head, the beam has slits, into which corresponding ends of the strings can be hooked.

Other features and advantages will hereinafter appear.

BRIEF DESCRIPTION OF THE DRAWINGS

One embodiment of the invention is illustrated in the drawings and described in the following text.

DESCRIPTION OF THE PREFERRED EMBODIMENT

Figures 1, 2, 3, 4, 5:
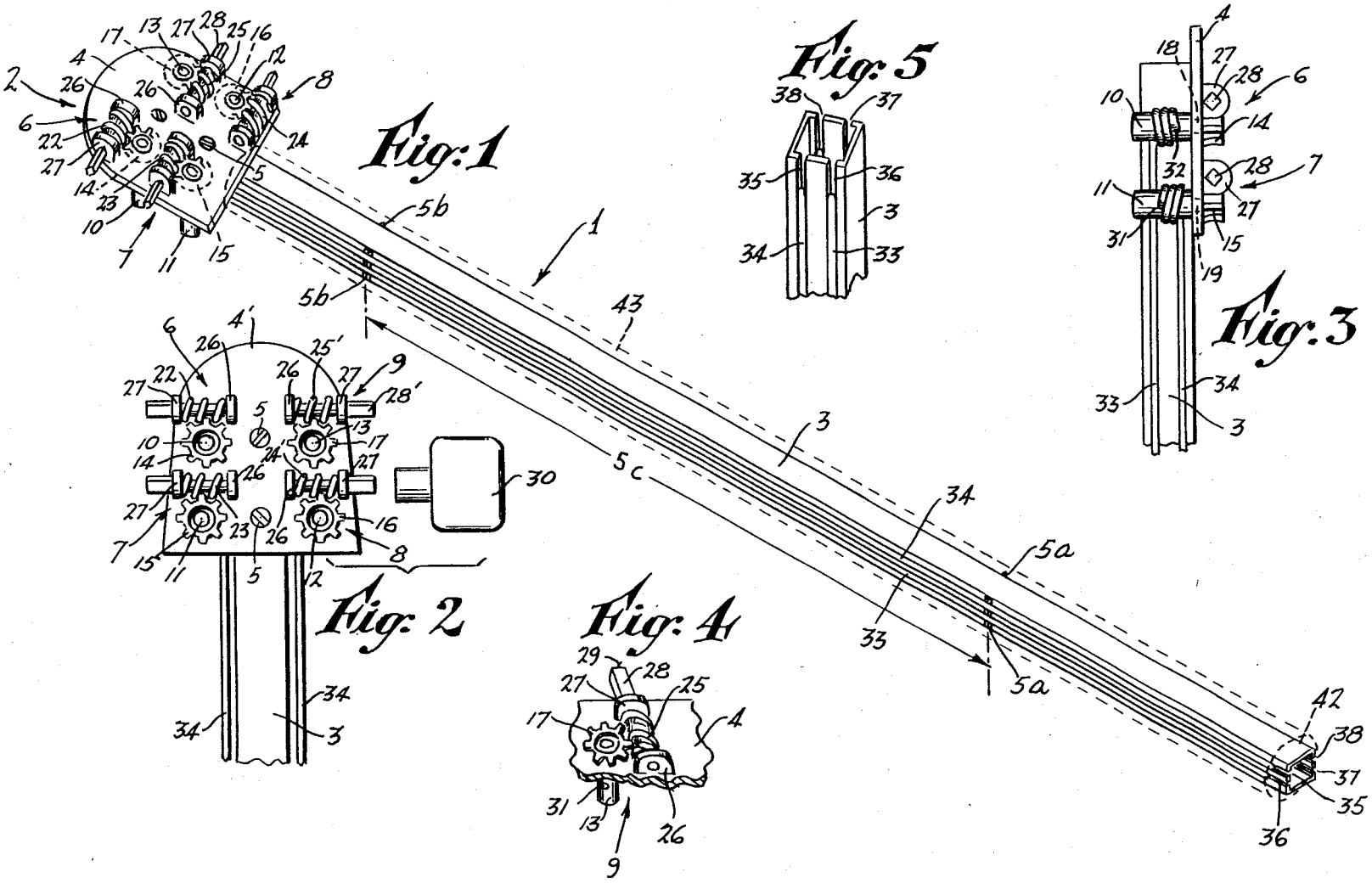
FIG. 1 is a perspective view of the tensioning device of the invention.
FIG. 2 is a fragmentary top plan view of the head part of the tensioning device, illustrating a modification of the invention.
FIG. 3 is a fragmentary side elevational view of the tensioning device's head part of FIG. 1.
FIG. 4 is a detail, in perspective, of one tensioning device.
FIG. 5 is a perspective view of the front end of the tensioning and holding device of FIG. 1 facing away from the head part.

The present improved device as illustrated in FIGS. 1 and 3–5 of the drawings, which serves to keep in readiness reserve strings for musical instruments, in particular violins and violas, is generally designated by the numeral 1; it consists essentially of a head part 2 and a square section tubular beam 3. The head part 2 is formed by a rounded-end plate 4, on whose underside or backside is disposed one end of the long beam 3. The dimensions of the plate 4 and beam 3 are selected so that the length of the beam 3 approximately equals or is slightly shorter than the length of the strings which are to be kept in readiness, while the rounded end portion of the plate 4 projects laterally beyond the end of the beam 3. The plate 4 can be joined to the beam 3, for example, by gluing. Other fastening modes, such as screws 5, or rivets are possible also. Provided in the lateral area of the plate 4 are four tensioning devices 6, 7, 8, and 9. The tensioning devices comprise shafts 10, 11, 12 and 13 respectively, which are rotatably mounted in the plate 4 and at whose ends worm wheels 14, 15, 16 and 17 are fastened. The plate 4 contains holes 18 and 19 in which the shafts 10, 11, 12 and 13 are mounted. The worm wheels 14, 15, 16 and 17 contact the top or front of the plate 4, thus taking care of an adequately secure mounting of the shafts 10, 11, 12 and 13 with protection against their axial shifting.

The worm wheels 14, 15, 16 and 17 are respectively in engagement with worms 22, 23, 24 and 25 whose longitudinal axes extend transverse to the central axis of the rounded plate 4. The worms 22, 23, 24 and 25 are mounted in two small bearing blocks each, two of which are designated 26, 27. Provided at the ends of the worms 22, 23, 24 and 25 are shafts, of which one is designated 28, that protrude beyond the lateral edges of the plate 4 and at whose face a square or hexagonal head 29 is provided, to which a tool such as a small wrench 30, see FIG. 2, can be attained for their operation. As can be seen in FIG. 3, the shafts 10, 11, 12 and 13 have, in the area under or in the back of the plate 4, holes 31 and 32, FIGS. 3 and 4, through which the ends of the reserve strings 33 and 34 can be stuck, for fastening. The holes 31 and 32 are staggered so that the reserve strings 33 and 34 are mutually spaced.

As is evident from FIG. 1, two string seating elements or frets 5*a*, 5*b* are provided on each of the two surfaces to be occupied by the reserve strings 33 and 34. The frets 5*a*, 5*b* are spaced a distance 5*c* apart in accordance with the diapason octave interval of the respective musical instrument type for which the reserve strings are intended.

The long beam 3 extends from the head part 2 and has four slits 35, 36, 37, and 38 at its end which is located away from the head part 2. Since ends of the musical strings are thickened anyway for mounting to the musical instrument, the slits 35, 36, 37 and 38 represent simple, effective fastening devices for the reserve strings which are to be mounted on the beam 3. The thickened ends of the strings are simply hooked into the proper slits 35, 36, 37 or 38. The respective other ends of the reserve strings 33, 34 are stuck through the holes 31 or 32 of the respective shafts so that only the respective tensioning devices 6, 7, 8 or 9 need to be operated to tension the strings. The reserve strings 33 and 34 are properly arranged across the frets 5a and 5b. All the user has to do then is to determine by plucking whether the vibration of the respective reserve string corresponds to the keynote of the string in the musical instrument. If so, it can be assumed that the pretension given the reserve string 33 or 34 corresponds essentially to the string tension which is to be generated when tuning the musical instrument.

The worms 22, 23, 24 and 25 with the worm wheels 14, 15, 16 and 17 constitute self-locking gear parts so that the reserve strings 33 and 34 are kept in the proper prestretched state that has been established.

FIG. 2 illustrates a slightly modified form of the invention wherein like parts have been given similar characters. In this modification, all of the worms are disposed above the respective worm wheels as seen in the figure. The plate is designated 4', two shafts are designated 28', and two worms are designated 25'.

To change a snapped string in the musical instrument, the musician selects the proper replacement. The respective tensioning device 6, 7, 8 or 9 is then rotated in a releasing direction so that the end of the respective reserve string can be taken out of the shaft hole of the tensioning device. This operation can be performed very quickly, so that the time needed for the entire string changing process is very short whereby no noticeable or significant relaxation of the string occurs.

For the protection of the reserve strings 33 and 34 there is provided a sheath 43 which can be made of transparent plastic, for example. The open end 42 of the sheth 43 is slid over the beam 3 including the reserve string it accommodates. The sheath 43 can be designed essentially as a rigid, tubular sleeve of essentially circular cross-section. Due to the rectangular section of the beam 3 there will exist within the round section of the sleeve 43, along the string surfaces of the beam, enough room for the reserve strings on the beam 3. Therefore, the diameter of the sleeve 43 can be relatively small, about the size of the diagonal of the square section of the beam 3. Due to this, and also due to the relatively small dimensions of the head part 2, the pretensioning device can be kept very small overall so that it can easily be accommodated in the violin case, requiring hardly more room than an additional violin bow carried in the violin case. To retain the sleeve 43 on the beam 3 with the necessary security, clamps (not shown) can be provided.

Variations and modifications are possible without departing from the spirit of the invention.

Each and every one of the appended claims defines an aspect of the invention which is separate and distinct from all others, and accordingly it is intended that each claim be treated in this manner when examined in the light of the prior art devices in any determination of novelty or validity.

What is claimed is:

1. A portable pretensioning device for keeping in readiness tuned, reserve strings for stringed musical instruments, comprising in combination:

(a) an elongate beam, (b) a tensioning head carried by the elongate beam at one end thereof, (c) a plurality of manually-operable string-attachment-and-draft means carried by the tensioning head, (d) said beam at the other end thereof being free, fully accessible, and unattached, and having quick-detach means cooperable with instrument strings to effect an anchorage of said strings, (e) a plurality of pre-stressed tensioned musical instrument strings extending along a side of said elongate beam, said strings having their ends connected respectively to said manually-operable string-attachment-and-draft means on the one hand and said quick-detach means on the other hand, (f) a fret carried by said elongate beam to facilitate tuning of the musical instrument strings to the desired musical notes, (g) said string-attachment-and-draft means on the one hand and quick-detach means on the other hand effecting a positioning of the instrument strings in juxtaposition to said one side of the beam and for engagement with said fret, (h) said tensioning head having a plate which supports the manually-operable string-attachment-and-draft means and is joined to one end of the beam, (i) said beam being formed of a tube of rectangular crosssection along whose mutually opposite walls the musical strings extend, (j) said string-attachment-and-draft means comprising worm wheels and shafts therefor, and cooperable worms, each of said shafts being laterally offset from the other shafts and with respect to an axis along the length of the beam and said shafts engaging the ends of the said strings and being mounted in holes in said plate so as to project from the plate, and (k) a removable sheath enclosing the beam and the said instrument strings, (l) said sheath being constituted essentially as a rigid, tubular sleeve having a round section.

2. A device according to claim 1, characterized in that the beam (3) is of a length essentially corresponding to the string length, and has an additional fret which is spaced a distance from the first-mentioned fret so as to correspond to the diapason of the respective instrument type for which the reserve strings are intended.

3. A device according to claim 1, wherein:

(a) said worms each have extension shafts with keying means thereon, and (b) a manually-engageable knob having cooperable keying means thereon for engagement with and disengagement from the keying means of the extension shafts, said keying means of the knob being universally compatible with the keying means of each extension shaft to permit the knob to be employed interchangeably with the extension shafts one at a time, thereby to enable manual adjustable turning thereof.

4. A device according to claim 1, characterized in that the one end of the beam extends under the said plate.

5. A device according to claim 1, characterized in that the said sheath consists of a transparent plastic.

6. A device according to claim 1, characterized in that the said plate is disposed flat against and is attached to one face of the beam, and protrudes laterally beyond the sides of the beam and has a rounded end.

7. A device according to claim 1, wherein:

(a) said string-attachment-and-draft means on the one hand, and said quick-detach means on the other hand, position the instrument strings along mutually opposite sides of said beam.

8. A device according to claim 1, characterized in that the beam has slits at its end opposite the tensioning head, into which slits the ends of the instrument strings can be hooked.

* * * * *